US012215580B2

(12) United States Patent
Hu et al.

(10) Patent No.: US 12,215,580 B2
(45) Date of Patent: Feb. 4, 2025

(54) DIFFERENTIAL PRESSURE SLIDING SLEEVE, AND OIL AND GAS WELL FRACTURING CONSTRUCTION METHOD USING SAME

(71) Applicants: CHINA PETROLEUM & CHEMICAL CORPORATION, Beijing (CN); SINOPEC SOUTHWEST OIL & GAS COMPANY, Sichuan (CN)

(72) Inventors: Shunqu Hu, Sichuan (CN); Yongmao Lin, Sichuan (CN); Wei Zhao, Sichuan (CN); Wei Lei, Sichuan (CN); Zhi Xie, Sichuan (CN); Zhimin Hou, Sichuan (CN); Chen Chen, Sichuan (CN); Qiang Wang, Sichuan (CN); Dan Hu, Sichuan (CN); Jingyu Cui, Sichuan (CN)

(73) Assignees: CHINA PETROLEUM & CHEMICAL CORPORATION, Beijing (CN); SINOPEC SOUTHWEST OIL & GAS COMPANY, Sichuan (CN)

( * ) Notice: Subject to any disclaimer, the term of this patent is extended or adjusted under 35 U.S.C. 154(b) by 0 days.

(21) Appl. No.: 18/563,069

(22) PCT Filed: Jun. 10, 2021

(86) PCT No.: PCT/CN2021/099473
§ 371 (c)(1),
(2) Date: Nov. 21, 2023

(87) PCT Pub. No.: WO2022/257080
PCT Pub. Date: Dec. 15, 2022

(65) Prior Publication Data

US 2024/0218773 A1 Jul. 4, 2024

(51) Int. Cl.
*E21B 43/26* (2006.01)
*E21B 34/14* (2006.01)

(52) U.S. Cl.
CPC ..... *E21B 43/26* (2013.01); *E21B 34/14* (2013.01); *E21B 2200/06* (2020.05)

(58) Field of Classification Search
CPC ..... E21B 43/26; E21B 34/14; E21B 2200/06
See application file for complete search history.

(56) References Cited

U.S. PATENT DOCUMENTS 5,310,000 A * 5/1994 Arterbury ..... E21B 43/11 166/228
6,769,490 B2 8/2004 Allamon et al.
(Continued)

FOREIGN PATENT DOCUMENTS

CN 201924905 U 8/2011
CN 204851170 U 12/2015
(Continued)

*Primary Examiner* — Aaron L Lembo
(74) *Attorney, Agent, or Firm* — NKL Law; Allen Xue

(57) ABSTRACT

A differential-pressure sliding sleeve has an outer cylinder with a flow guiding hole being provided in a wall of the outer cylinder, an inner cylinder arranged in an inner cavity of the outer cylinder, an upper joint extending into the outer cylinder and fixedly connected to an upper end of the outer cylinder, a lower joint extending into the outer cylinder and fixedly connected to a lower end of the outer cylinder, and a dissolvable carrier ring arranged between the lower joint and the inner cylinder. An area of the axial upper end surface of the inner cylinder is greater than that of an axial lower end surface thereof, so that the working fluid generates a pressure difference to provide downward pressure for the inner cylinder, which moves downward under the pressure after the carrier ring is dissolved to open the flow guiding hole.

13 Claims, 4 Drawing Sheets

(56) References Cited

U.S. PATENT DOCUMENTS

| | | | | |
|---|---|---|---|---|
| 9,920,601 | B2 * | 3/2018 | Carrejo | E21B 43/12 |
| 9,976,384 | B2 * | 5/2018 | Resweber | E21B 33/146 |
| 10,927,644 | B2 * | 2/2021 | Atilano | E21B 43/14 |
| 11,142,989 | B2 * | 10/2021 | Gan | E21B 43/26 |
| 11,236,590 | B2 * | 2/2022 | Gan | E21B 43/114 |
| 11,885,201 | B2 * | 1/2024 | Gan | E21B 34/14 |
| 11,933,138 | B2 * | 3/2024 | Hou | E21B 43/26 |

FOREIGN PATENT DOCUMENTS

| | | | |
|---|---|---|---|
| CN | 204851209 | U | 12/2015 |
| CN | 105672943 | A | 6/2016 |
| CN | 113323627 | A | 8/2021 |

* cited by examiner

DIFFERENTIAL PRESSURE SLIDING SLEEVE, AND OIL AND GAS WELL FRACTURING CONSTRUCTION METHOD USING SAME

TECHNICAL FIELD

The present invention relates to the technical field of oil and natural gas well completion and reservoir reformation, and specifically to a differential-pressure sliding sleeve, and an oil and gas well fracturing construction method using the same.

TECHNICAL BACKGROUND

In recent years, oil and gas well exploration and exploitation have developed rapidly. Shale gas well, in particular, has attracted wide attention. In general, there are two methods for first section fracturing reformation of shale gas well, i.e., a method using coiled tubing perforation, and a method using differential-pressure sliding sleeve. The coiled tubing perforation method is mainly used to open the first section of the wellbore, which is a relatively mature technology at present. However, when applied to shale gas well, the coiled tubing perforation method has low construction effectiveness and high construction cost. In addition, with the increase in the number of shale gas wells drilled and the scale of fracturing, opening the first section with the coiled tubing perforation method cannot meet the demand in construction.

The differential-pressure sliding sleeve can be directly opened by pressure building-up, which can avoid the step of coiled tubing perforation, and thus can improve construction effectiveness and save construction cost. However, the existing differential-pressure sliding sleeve still has some defects. For example, the success rate of opening the differential-pressure sliding sleeve is low, leaving a relatively small operation window for the differential-pressure sliding sleeve. Meanwhile, the full wellbore testing pressure of a shale gas well is generally above 90 MPa, and the pressure level of the wellhead device is 105 MPa, which result in a relatively small pressure range for opening the differential-pressure sliding sleeve, so that it is difficult to open an ordinary differential-pressure sliding sleeve with a pressure within the above range. In addition, the opening pressure of the differential-pressure sliding sleeve needs to be higher than the full wellbore testing pressure, which leads to a considerable risk. Furthermore, the ordinary time-delayed differential-pressure sliding sleeve has a time-delayed structure with a small fluid inlet, which is prone to clogging and thus difficult to open. The time-delayed differential-pressure sliding sleeve also suffers from short time delay, which makes it impossible for repeated pressure tests, and so on.

SUMMARY OF THE INVENTION

Aiming at the above technical problems existing in the prior arts, the present invention proposes a differential-pressure sliding sleeve, which can be opened with a relatively small pressure that is lower than the full wellbore testing pressure, thereby ensuring a stable and reliable opening performance, and reducing the difficulty of opening the differential-pressure sliding sleeve, as well as the risk in construction. With the advantage of a simple structure, the differential-pressure sliding sleeve is easy to operate, thereby simplifying the construction steps, reducing the construction cost and improving the construction efficiency.

In one aspect of the present invention, a differential-pressure sliding sleeve is provided, which comprises an outer cylinder, with a flow guiding hole being provided in a wall of the outer cylinder; an inner cylinder arranged in an inner cavity of the outer cylinder, wherein in an initial state, the inner cylinder and the outer cylinder are fixed to each other to close the flow guiding hole; an upper joint extending into the inner cavity of the outer cylinder and fixedly connected to an upper end of the outer cylinder, wherein a clearance is formed between a lower end surface of the upper joint and an axial upper end surface of the inner cylinder; a lower joint extending into the inner cavity of the outer cylinder and fixedly connected to a lower end of the outer cylinder; and a carrier ring arranged in the inner cavity of the outer cylinder and between the lower joint and the inner cylinder, the carrier ring being dissolvable under an action of working fluid. An area of the axial upper end surface of the inner cylinder is configured to be greater than that of an axial lower end surface thereof, so that the working fluid generates a pressure difference between the axial upper and lower end surfaces of the inner cylinder to provide a downward pressure for the inner cylinder, which moves downward under the pressure after the carrier ring is dissolved to open the flow guiding hole.

In a preferred embodiment, an upper end portion of the inner cylinder is provided with an annular boss extending radially outward, so that the area of the axial upper end surface of the inner cylinder is greater than that of the axial lower end surface thereof.

In a preferred embodiment, an inner surface of the outer cylinder is provided with a shoulder portion extending radially inward, wherein an outer diameter of the annular boss is configured to be the same as an inner diameter of the outer cylinder, and an inner diameter of the shoulder portion is configured to be the same as an outer diameter of the inner cylinder.

In a specific embodiment, an axial length of the annular boss is configured to be less than an axial distance from an axial upper end surface of the shoulder portion to the flow guiding hole.

In a preferred embodiment, the carrier ring is made of magnesium aluminum alloy, polytetrafluoroethylene, degradable plastic, or degradable ceramic material.

In a preferred embodiment, the flow guiding hole is filled with filler, and a protective element is arranged radially outside of the filler, at least one guiding hole being arranged on the protective element.

In a specific embodiment, the filler is selected from a group consisting of viscous liquid, lubricating grease and resin.

In a specific embodiment, the protective element is fixed to the outer cylinder through adhesion or welding.

In a preferred embodiment, a size of the guiding hole is configured to be smaller than that of the flow guiding hole.

In a specific embodiment, a guiding hole corresponding to a center of the flow guiding hole is provided.

In a preferred embodiment, the guiding hole is configured as an elongated slit, with a circular through hole being provided at each end of the slit.

In a preferred embodiment, the flow guiding hole comprises two steps formed on an outer wall of the outer cylinder and opposite to each other axially, the protective element being placed on the two steps.

In a preferred embodiment, a clearance in communication with the flow guiding hole is provided between the outer cylinder and the inner cylinder, and outside of each axial end of the flow guiding hole.

In a preferred embodiment, the clearance is an enlarged hole formed on the inner wall of the outer cylinder, the enlarged hole comprising a sloping surface, so that the clearance narrows in a direction away from the flow guiding hole.

According to another aspect of the present invention, an oil and gas well fracturing construction method using the differential-pressure sliding sleeve is provided, which comprises: connecting the differential-pressure sliding sleeve to a string, which is then lowered into a fracturing formation in a wellbore; injecting working fluid into the string from a wellhead, so that the carrier ring is dissolved under the action of the working fluid; building up pressure in the wellbore, so that the inner cylinder generates a downward pressure under the action of the working fluid, and moves downward after the pressure reaches a predetermined pressure value, thereby opening the flow guiding hole; and communicating the string with the fracturing formation to perform fracturing construction.

BRIEF DESCRIPTION OF THE DRAWINGS

In the following preferred embodiments of the present invention will be described in detail with reference to the accompanying drawings. In the drawings.

In the drawings, the same reference numerals are used to indicate the same components. The drawings are not necessarily drawn to actual scale.

DETAILED DESCRIPTION OF EMBODIMENTS

The present invention will be further described below with reference to the accompanying drawings. In the context of the present invention, directional terms "upper", "upstream", "upward" or the like refer to a direction toward the wellhead, while directional terms "down", "downstream", "downward" or the like refer to a direction away from the wellhead. In addition, the direction along the length of the differential-pressure sliding sleeve is indicated as "longitudinal direction" or "axial direction", and the direction perpendicular to the "longitudinal direction" or "axial direction" is indicated as "radial direction", wherein the orientation of the radial direction toward the formation is indicated as "radially outside" while the orientation thereof away from the formation is indicated as "radially inside".

Figure 1:
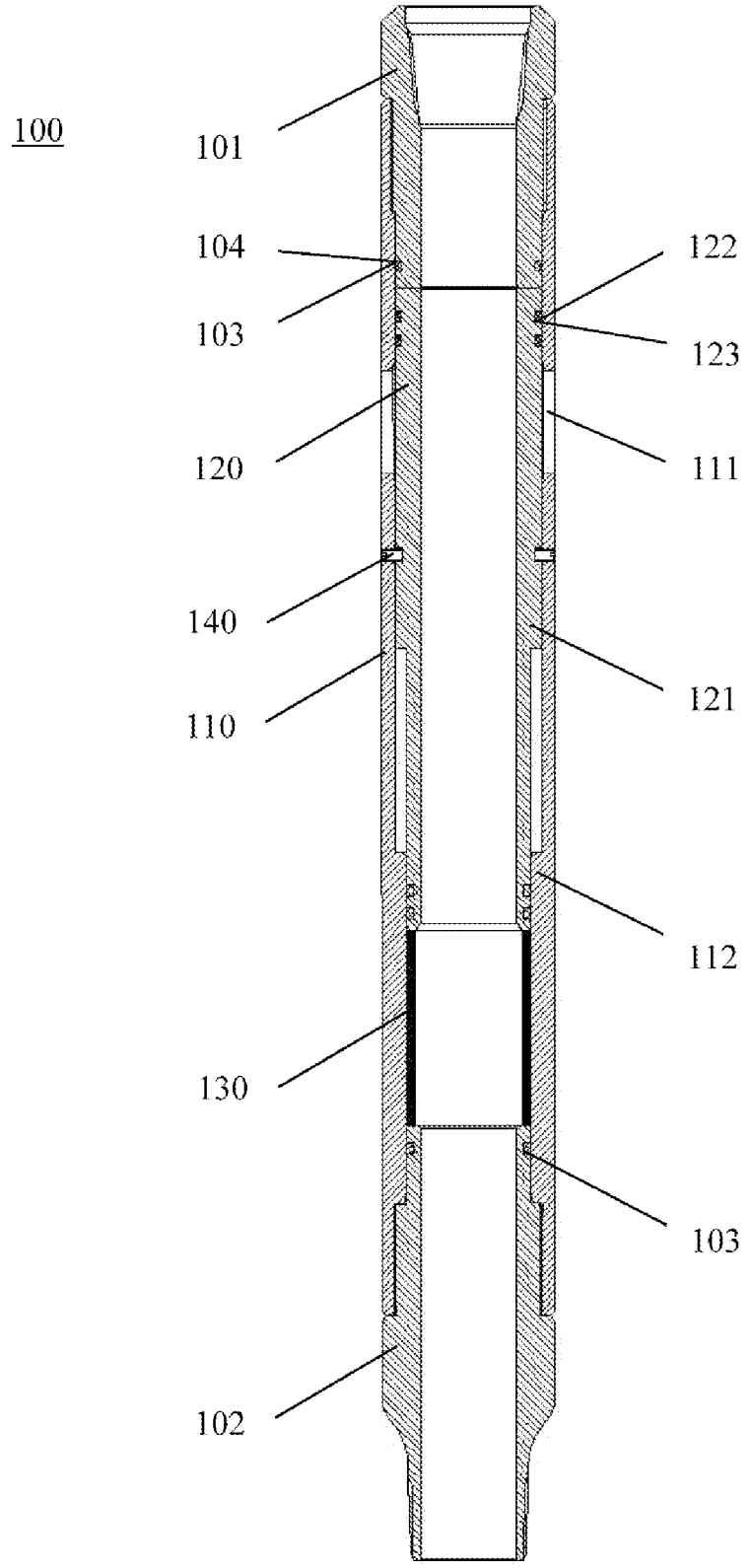
FIG. 1 schematically shows a differential-pressure sliding sleeve in a closed state according to the present invention.

FIG. 1 schematically shows a differential-pressure sliding sleeve 100 in a closed state according to one embodiment of the present invention. As shown in FIG. 1, the differential-pressure sliding sleeve 100 comprises an outer cylinder 110. According to the embodiment shown in FIG. 1, each end of the outer cylinder 110 is configured as a step-shaped negative thread connector. An upper joint 101 and a lower joint 102 for connecting to a downhole string are connected to both ends of the outer cylinder 110, respectively. In an embodiment not shown, each end of the outer cylinder 110 is configured as a step-shaped positive thread connector. In this manner, both ends of the outer cylinder 110 are connected, via the step-shaped positive thread connectors, to the step-shaped negative thread connectors of the upper joint 101 and the lower joint 102, respectively, thereby forming a fixed connection. The connection structure of the outer cylinder 110 is simple and convenient, which ensures high installation efficiency, as well as stable and reliable connection with other parts.

In this embodiment, a sealing element 103 is provided between connecting surfaces of the outer cylinder 110 to the upper joint 101 and the lower joint 102, respectively, in order to ensure the sealing performance of the connection of the outer cylinder 110 to the upper joint 101 and the lower joint 102. In one embodiment, a sealing recess 104 extending radially inward is provided on each of the step-shaped positive thread connectors of the upper joint 101 and the lower joint 102, wherein the sealing element 103 is arranged in the sealing recess 104. Preferably, the sealing element 103 is an O-ring seal.

As shown in FIG. 1, at least one, and preferably a number of, flow guiding holes 111 are provided on a sidewall of the outer cylinder 110. The flow guiding holes 111 are provided on the outer cylinder 110 at a same axial position, and are evenly spaced apart along the circumferential direction. An inner cylinder 120 is provided inside the outer cylinder 110, and located between the upper joint 101 and the lower joint 102. The inner cylinder 120 is configured to close the flow guiding holes 111 on the outer cylinder 110, and move within the outer cylinder 110 to open the flow guiding holes 111.

In the embodiment as shown in FIG. 1, the inner cylinder 120 is arranged on an inner wall of the outer cylinder 110 through a shear pin 140, and thus is fixedly connected to the outer cylinder 110. In this embodiment, a through hole for installing the shear pin 140 is provided on the sidewall of the outer cylinder 110, and an installation recess corresponding to the through hole is provided on an outer surface of the inner cylinder 120. The shear pin 140 passes through the through hole and is installed into the installation recess. In an initial state (i.e., the closed state) of the differential-pressure sliding sleeve 100 as shown in FIG. 1, the inner cylinder 120 closes the flow guiding holes 111, and a gap is formed between an upper end surface of the inner cylinder 120 and a lower end surface of the upper joint 101.

Figure 2:
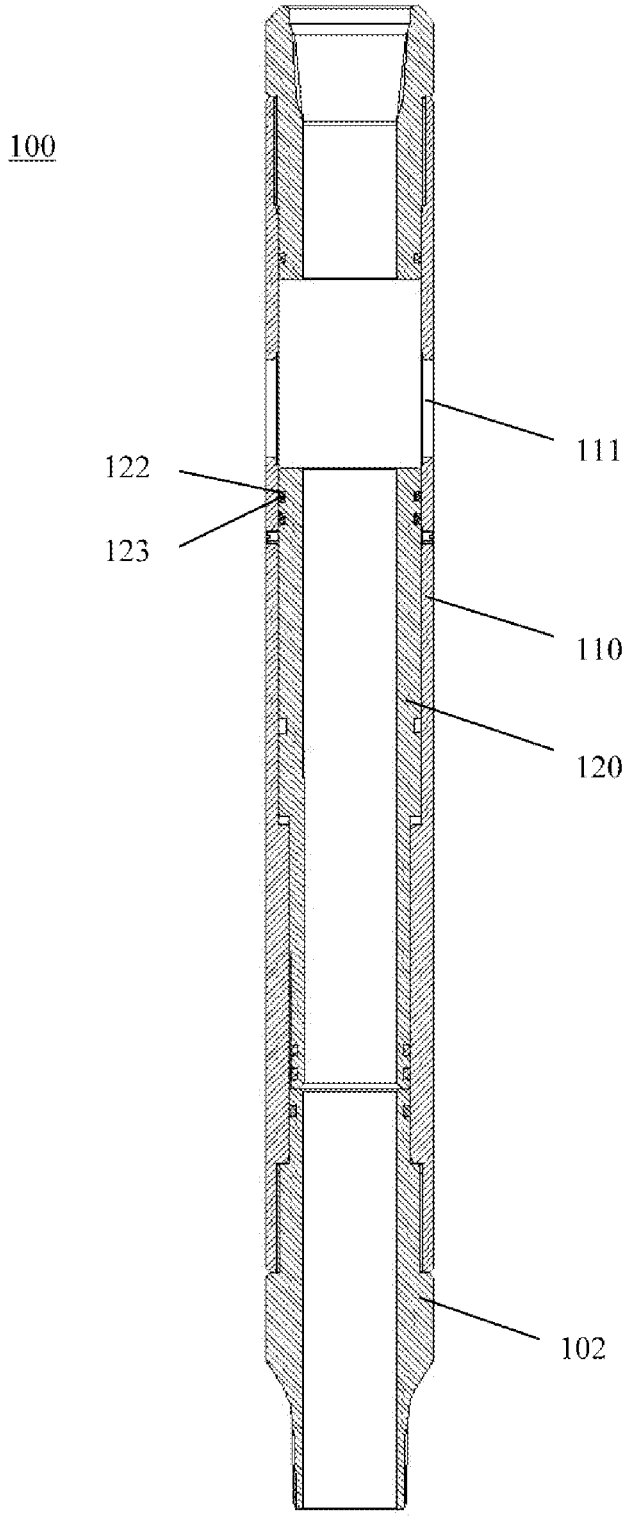
FIG. 2 schematically shows a differential-pressure sliding sleeve in an open state according to the present invention.

After the inner cylinder 120 is subjected to an axially downward force reaching a shearing pressure of the shear pin 140, the shear pin 140 is sheared off, so that the inner cylinder 120 can move downward relative to the outer cylinder 110, thereby releasing the closure of the flow guiding holes 111 from the inside. That is, the flow guiding holes 111 are opened. In this case, the differential-pressure sliding sleeve 100 is in an open state, as shown in FIG. 2.

According to the present invention, an upper end of the inner cylinder 120 is provided with an annular boss 121 extending radially outward, so that the area of an axial upper end surface of the inner cylinder 120 is larger than that of an axial lower end surface thereof. In this manner, a pressure difference will be formed between two axial ends of the inner cylinder 120 under the action of working fluid, thereby providing a downward pressure on the inner cylinder 120. At the same time, an annular shoulder portion 112 extending radially inward is provided on an inner wall surface of a lower end portion of the outer cylinder 110. The outer diameter of the annular boss 121 is configured to be the same as the inner diameter of the outer cylinder 110, and the inner diameter of the shoulder portion 112 is configured to be the same as the outer diameter of the inner cylinder 120, so that the inner cylinder 120 is able to move downward along the outer cylinder 110. According to the present invention, the axial length of the annular boss 121 is configured to be less than an axial distance from an axial upper end surface of the shoulder portion 112 to the flow guiding holes 111, so as to ensure that the flow guiding holes 111 on the outer cylinder 110 can be completely opened when the inner cylinder 110 moves downward.

According the present invention, the differential-pressure sliding sleeve 100 further comprises a carrier ring 130. As shown in FIG. 1, the carrier ring 130 is provided between the inner cylinder 120 and the lower joint 102, wherein an upper end surface of the carrier ring 130 is in contact with a lower end surface of the inner cylinder 120, and a lower end surface of the carrier ring 130 is in contact with an upper end surface of the lower joint 102. According to the present invention, the carrier ring 130 is made of dissolvable material, such as magnesium aluminum alloy, polytetrafluoroethylene, degradable plastic, degradable ceramic material, or the like. In this manner, the carrier ring 130 is able to dissolve naturally under the action of the working fluid, and provide support to the inner cylinder 120 before it has completely dissolved. As a result, in the differential-pressure sliding sleeve 100 the inner cylinder 120 and the outer cylinder 110 can be fixed to each other through a shear pin with a relatively small shearing pressure, ensuring that the shear pin can be sheared off through a relatively small pressure after the carrier ring 130 is completely dissolved. In this case, the differential-pressure sliding sleeve 100 can be opened with a relatively small pressure, enabling it less difficult to open the differential-pressure sliding sleeve 100.

Thus, the differential-pressure sliding sleeve 100 according to the present invention, after being lowered in, can withstand the pressure of the inner cylinder through the carrier ring 130. At this moment, the shear pin 140 is not under pressure, so that the wellhead pressure can be selected to exceed the shearing pressure of the shear pin 140, without causing the shear pin 140 to be sheared off. In other words, the shear pin 140 may be selected to have a relatively small shearing pressure so that it can be sheared off more easily, thereby reducing the risk of failing to open the differential-pressure sliding sleeve 100. In addition, the carrier ring 130 can occupy the area between the lower end surface of the inner cylinder 120 and the upper end surface of the lower joint 102 before it is completely dissolved. As a result, in addition to withstanding the pressure of the inner cylinder, the carrier ring 130 can effectively prevent mud or other solid impurities in the working fluid from solidifying on or adhering to the inner wall of the outer cylinder 110, which may block the downward movement of the inner cylinder 120. Therefore, the difficulty in opening the differential-pressure sliding sleeve 100 can be further reduced.

According to one embodiment of the present invention, the dissolution rate of the carrier ring 130 can be adjusted through the working fluid. Specifically, suitable working fluid can be prepared according to the needs during the construction progress, so that the carrier ring 130 can be completely dissolved within a set period.

After the differential-pressure sliding sleeve 100 according to the present invention is lowered into the wellbore with the string, a high-pressure working fluid is first pumped in from the wellhead. In this manner, the carrier ring 130 will come into contact with the working fluid, and thus is naturally dissolved under the action of the working fluid. At this moment, the inner cylinder 120 is fixed to the outer cylinder 110 only under the action of the shear pin 140. The high-pressure working fluid generates high pressure within the string, and forms a pressure difference between the upper and lower end surfaces of the inner cylinder 120 with different areas. Since the area of the upper end surface of the inner cylinder 120 is larger than that of the lower end surface thereof, and there is a gap between the upper end surface of the inner cylinder 120 and the lower end surface of the upper joint 101, the pressure on the upper end surface of the inner cylinder 120 is greater than the pressure on the lower end surface thereof. As a result, the working fluid exerts a downward pressure on the inner cylinder 120. After the pressure on the inner cylinder 120 reaches a predetermined pressure value (i.e., the shearing pressure of the shear pin 140), the inner cylinder 120 shears off the shear pin 140, and continues to move downward under the pressure to expose the flow guiding holes 111 on the outer cylinder 110. The predetermined pressure value may be set according to the actual situation, generally within a range of 10-120 MPa. The inner cylinder moves downward until the lower end surface of the inner cylinder 120 abuts against the upper end surface of the lower joint 102, thereby axially limiting the inner cylinder 120. In this manner, the flow guiding holes 111 are completely opened, and the differential-pressure sliding sleeve 100 is in an open state, so that the space inside the downhole string is in communication with that outside the downhole string.

In order to ensure the sealing performance between the inner cylinder 120 and the outer cylinder 110, at least one sealing element 123 is provided between the contact surfaces between the inner cylinder 120 and the outer cylinder 110. Preferably, the sealing element 123 is configured as an O-ring seal. As shown in FIG. 2, a number of sealing recesses 122 are provided on the outer surface of the inner cylinder 120. For example, two sealing recesses 122 are provided on the outer surface of the inner cylinder 120 at the axially outer sides of both ends of the inner cylinder 120, wherein a sealing element 123 is arranged in each of the sealing recesses 122. The sealing element 123 can effectively ensure the sealing performance between the inner cylinder 120 and the outer cylinder 110, thereby improving the working performance of the differential-pressure sliding sleeve 100.

According to a second aspect of the present invention, an oil and gas well fracturing construction method using the differential-pressure sliding sleeve 100 according to the present invention is provided. The construction method comprises the following steps. First, the differential-pressure sliding sleeve 100 is connected to a downhole string of a fracturing tool string, after which the differential-pressure sliding sleeve 100 is lowered along with the downhole string into the fracturing formation in a wellbore. Then, working fluid is injected into the downhole string from the wellhead, so that the carrier ring 130 is naturally dissolved under the action of the working fluid. After the carrier ring 130 is dissolved, the pressure is built up in the wellbore, so that the working fluid forms a pressure difference between the upper and lower end surfaces of the inner cylinder 120, thereby exerting a downward pressure on the inner cylinder 120. The inner cylinder 120 shears off the shear pin 140 after the pressure reaches a predetermined pressure value, and moves downward along the outer cylinder 110, until the upper end surface of the annular boss 121 is in contact with the upper end surface of the shoulder portion 112, thereby completely opening the flow guiding holes 111. Then, the downhole string comes in communication with the fracturing formation through the flow guiding holes 111, whereby the oil and gas well fracturing construction can be performed.

The fracturing construction method according to the present invention is simple to achieve, and in particular, it is able to open the flow guiding holes 111 under a relatively low pressure to realize the communication with the fracturing formation. At the same time, the fracturing construction method according to the present invention shortens the fracturing operation cycle and improves the fracturing construction effect.

The differential-pressure sliding sleeve 100 according to the present invention can be opened at a pressure lower than the full-wellbore testing pressure, so that the differential-pressure sliding sleeve 100 can be opened through a relatively low pressure. The stable and reliable opening performance can be ensured, enabling it less difficult to open the differential-pressure sliding sleeve 100, and reducing the risk during the construction operation. The differential-pressure sliding sleeve 100 opens the flow guiding holes by forming a pressure difference through the structure of the inner cylinder 120, which can avoid the use of components for pressure building-up, and simplify the structure of the differential-pressure sliding sleeve 100. In addition, the differential-pressure sliding sleeve 100 can effectively ensure the sealing performance between the inner cylinder 120 and the outer cylinder 110, so that the opening performance of the differential-pressure sliding sleeve 100 can be ensured. Meanwhile, the differential-pressure sliding sleeve 100 is simple and convenient to operate, which simplifies the construction steps, reduces the construction cost, and improves the construction efficiency. Furthermore, the oil and gas well fracturing construction method using the differential-pressure sliding sleeve 100 according to the present invention consists of simple construction steps, which is able to open the flow guiding holes 111 under a relatively small pressure to realize the communication with the fracturing formation, thus significantly improving the fracturing construction efficiency, and enhancing the fracturing construction effect.

As described above, in the differential-pressure sliding sleeve 100 according to the present invention, the carrier ring 130 is adopted to occupy the area between the lower end surface of the inner cylinder 120 and the upper end surface of the lower joint 102, thereby effectively preventing mud or other solid impurities in the working fluid from solidifying on or adhering to the inner wall of the outer cylinder 110, which may block the downward movement of the inner cylinder 120. As a result, the difficulty in opening the differential-pressure sliding sleeve 100 is further reduced. However, during the downward movement of the sliding sleeve, the mud, rock debris and other impurities in the wellbore may enter the flow guiding holes. Also, during well-cementing operation, the cement slurry may enter into the flow guiding holes also, causing the flow guiding holes to be cemented. All of the above situations will lead to failure to open the sliding sleeve, and thus affect the fracturing construction.

In this regard, based on the principle similar to that of the carrier ring 130, a protective device for flow guiding hole is provided according to a third aspect of the present invention.

Figure 3:
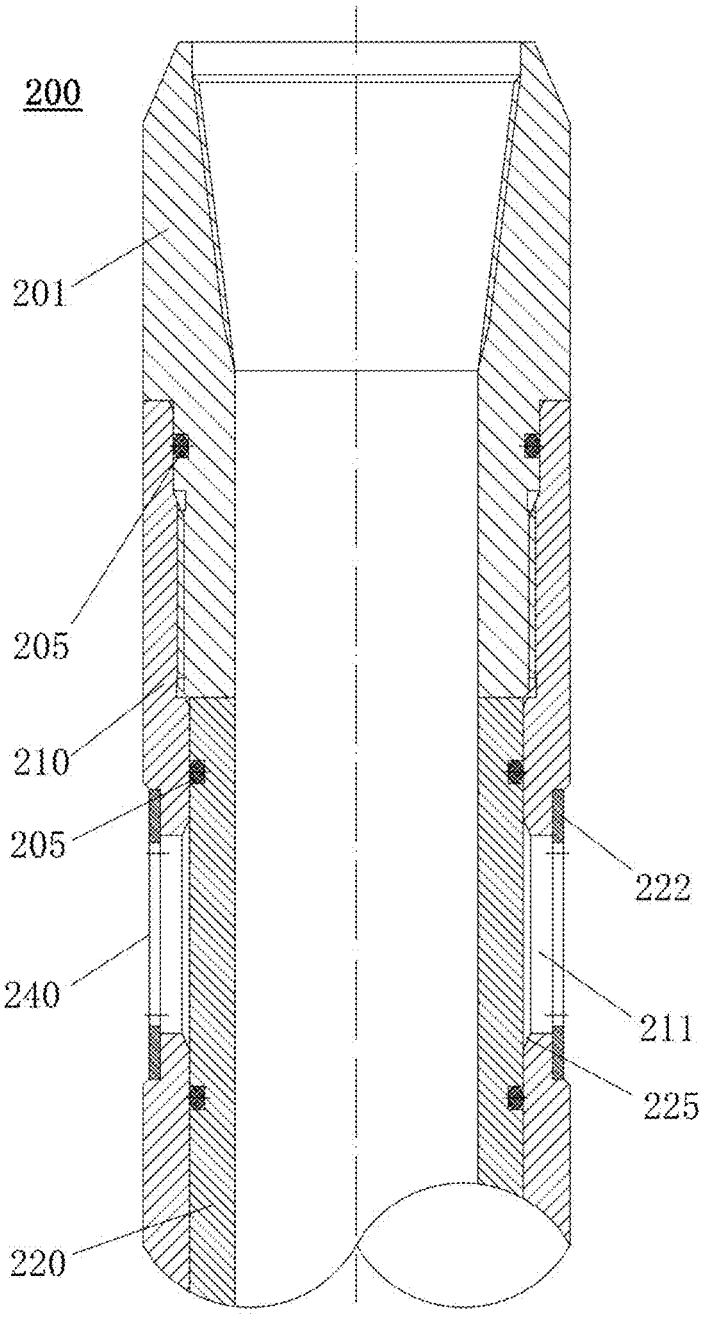
FIG. 3 schematically shows a differential-pressure sliding sleeve according to another embodiment of the present invention, which comprises a protective device for flow guiding hole.

FIG. 3 shows a differential-pressure sliding sleeve 200 according to another embodiment of the present invention. For the sake of clarity, only a portion of the differential-pressure sliding sleeve 200 is shown in FIG. 3. The differential-pressure sliding sleeve 200 comprises an upper joint 201, an outer cylinder 210, an inner cylinder 220, and a lower joint (not shown). A number of flow guiding holes 211 are provided on the outer cylinder 210 distributed evenly along a circumferential direction. A sealing ring 205 is provided between the upper joint 201 and the outer cylinder 210, and between the outer cylinder 210 and the inner cylinder 220, respectively. These members and the functions thereof are the same as those described with respect to the differential-pressure sliding sleeve 100 according to the present invention, and the detailed description thereof is omitted herein.

According to the present invention, a protective element 240 is provided at the flow guiding hole 211. According to one embodiment, the protective element 240 has an outer diameter that is no larger than an outer diameter of the outer cylinder 210. According to one embodiment, the flow guiding hole 211 is filled with highly viscous liquid, and the protective element 240 is provided radially outside of the highly viscous liquid, thereby effectively preventing the highly viscous liquid in the flow guiding hole from flowing out, and preventing the external mud or cement slurry from entering. At the same time, the protective element 240 is also able to prevent external rock debris and other impurities from entering the flow guiding hole 211. In an alternate embodiment, the flow guiding hole 211 can be filled with lubricating grease, which can provide lubrication for the relative motion between the inner cylinder and the outer cylinder, thus facilitating the smooth relative motion. In another alternative embodiment, the flow guiding hole 211 can be filled with resin.

Figure 4:
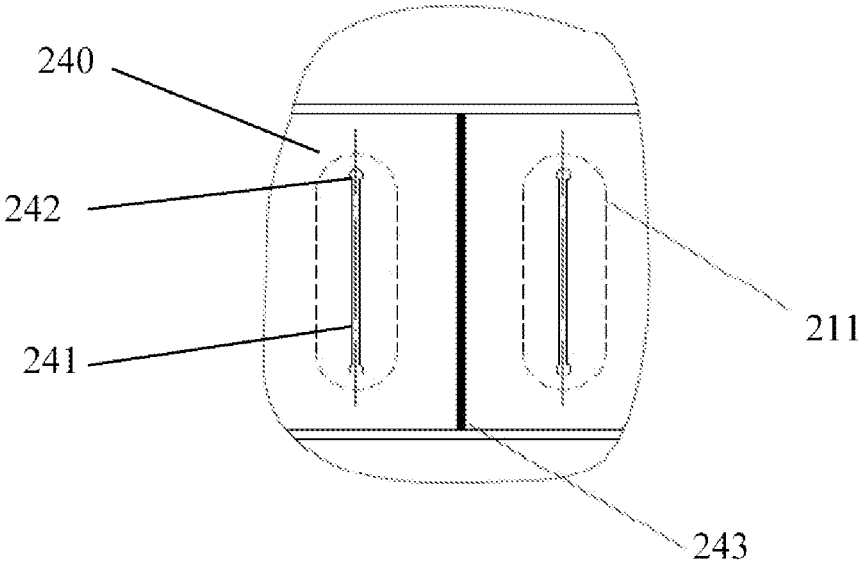
FIG. 4 is a partial view schematically showing the protective device for flow guiding hole according to the present invention.

In a preferred embodiment according to the present invention, as shown in FIG. 4, a guiding hole 241 is provided on the protective element 240 at a position corresponding to the center of the flow guiding hole 211. Preferably, the size of the guiding hole 241 is selected to be smaller than the size of the flow guiding hole 211, so that the guiding hole 241 is completely in the area of the flow guiding hole 211. By providing the guiding hole on the protective element at a position corresponding to the center of the flow guiding hole, the outflow of the fluid can be guided, thereby solving the problem of high formation fracture pressure caused by casing cementing.

In a specific embodiment as shown in FIG. 4, the guiding hole 241 is configured as an elongated slit. The guiding hole has a simple structure, which easy to process, and can better avoid high formation fracture pressure caused by casing cementing. Further, as shown in FIG. 4, in this embodiment, circular through holes 242 are provided at both ends of the slit. By providing circular through holes, it is possible to avoid the problem of stress concentration at both ends of the elongated slit.

In a specific embodiment as shown in FIG. 3, two steps 222 opposite to each other are provided on the outer wall of the outer cylinder 210. The two steps 222 are located at both axial ends of the flow guiding hole 211, respectively. In this manner, the protective element 240 can span over the two steps 222. Preferably, the depth of the step 222 is greater than the thickness of the protective element 240. With the above arrangement, the outer wall of the protective element 240 will not protrude from the outer wall of the outer cylinder 210, thereby ensuring the safety of the protective element 240, and avoiding the situation that the protective element 240 is accidentally damaged when the sliding sleeve is lowered. At the same time, the accurate positioning of the protective element 240 can be ensured to a great extent by the steps 222, and the installation thereof is secure and convenient.

According to the present invention, the protective element 240 can be fixed with the outer cylinder 210 through metal adhesive, which can simplify the structure of the entire protective device. In this manner, the protective device with high structural strength is simple and convenient to operate, thereby preventing the protective element from protruding from the outer cylinder due to fasteners in other connection methods, which may affect the process of drilling or completion.

In an alternative embodiment, the protective element 240 can also be fixed to the outer cylinder 210 through welding.

In an embodiment according to FIG. 3, a clearance 225 in communication with the flow guiding hole 211 is provided between the outer cylinder 210 and the inner cylinder 220 in a position outside of each axial end of the flow guiding hole 211. The clearance may be provided only on the inner wall of the outer cylinder 210, or only on the outer wall of the inner cylinder 220, or on the both. In a specific embodiment, an enlarged hole may be provided on the inner wall of the outer cylinder 220 immediately outside the flow guiding hole 211. A wall surface of the enlarged hole is preferably configured to have a sloping surface, so that the clearance narrows in both directions axially away from the flow guiding hole 211. With the above arrangement, the lubricating grease in the flow guiding hole 211 can easily enter the clearance, so that the lubricating grease can be smoothly driven to the area between the inner cylinder 220 and the outer cylinder 210 following the movement of the inner cylinder 220, which further ensures the smooth downward movement of the inner cylinder 220. Furthermore, the sloping surface ensures the clearance is gradually smaller in size, which acts as a barrier to prevent impurities from entering the area between the inner cylinder and the outer cylinder.

The protective device for flow guiding hole according to the present invention can effectively prevent the highly viscous liquid in the flow guiding hole from flowing out, so that the flow guiding hole can be filled with the highly viscous liquid, preventing the external mud or cement slurry from entering, and at the same time, preventing external impurities such as rock debris from entering the flow guiding hole.

While the present invention has been described above with reference to the exemplary embodiments, various modifications may be made and components may be replaced with equivalents thereof without departing from the scope of the present invention. In particular, as long as there is no structural conflict, each technical feature mentioned in each embodiment can be combined in any manner. The present invention is not limited to the specific embodiments disclosed herein, but includes all technical solutions falling within the scope of the claims.

The invention claimed is:

1. A differential-pressure sliding sleeve, comprising:

an outer cylinder, with a flow guiding hole being provided in a wall of the outer cylinder;

an inner cylinder arranged in an inner cavity of the outer cylinder, wherein in an initial state, the inner cylinder and the outer cylinder are fixed to each other to close the flow guiding hole;

an upper joint extending into the inner cavity of the outer cylinder and fixedly connected to an upper end of the outer cylinder, wherein a clearance is formed between a lower end surface of the upper joint and an axial upper end surface of the inner cylinder;

a lower joint extending into the inner cavity of the outer cylinder and fixedly connected to a lower end of the outer cylinder; and a carrier ring arranged in the inner cavity of the outer cylinder and between the lower joint and the inner cylinder, the carrier ring being dissolvable under an action of working fluid, wherein an area of the axial upper end surface of the inner cylinder is greater than that of an axial lower end surface thereof, so that the working fluid generates a pressure difference between the axial upper and lower end surfaces of the inner cylinder to provide a downward pressure for the inner cylinder, which moves downward under the pressure after the carrier ring is dissolved to open the flow guiding hole, wherein the flow guiding hole is filled with a filler, a protective element is arranged radially outside of the filler, at least one guiding hole is arranged on the protective element, and wherein the size of the at least one guiding hole is smaller than that of the flow guiding hole.

2. The differential-pressure sliding sleeve according to claim 1, wherein an upper end portion of the inner cylinder is provided with an annular boss extending radially outward, so that the area of the axial upper end surface of the inner cylinder is greater than that of the axial lower end surface thereof.

3. The differential-pressure sliding sleeve according to claim 2, wherein an inner surface of the outer cylinder is provided with a shoulder portion extending radially inward, wherein an outer diameter of the annular boss is the same as an inner diameter of the outer cylinder, and an inner diameter of the shoulder portion is the same as an outer diameter of the inner cylinder.

4. The differential-pressure sliding sleeve according to claim 3, wherein an axial length of the annular boss is less than an axial distance from an axial upper end surface of the shoulder portion to the flow guiding hole.

5. The differential-pressure sliding sleeve according to claim 1, wherein the carrier ring is made of magnesium aluminum alloy, polytetrafluoroethylene, degradable plastic, or degradable ceramic material.

6. The differential-pressure sliding sleeve according to claim 1, wherein the filler is selected from a group consisting of viscous liquid, lubricating grease, and resin.

7. The differential-pressure sliding sleeve according to claim 1, wherein the protective element is fixed to the outer cylinder through adhesion or welding.

8. The differential-pressure sliding sleeve according to claim 1, wherein the at least one guiding hole corresponds to a center of the flow guiding hole.

9. The differential-pressure sliding sleeve according to claim 1, wherein the at least one guiding hole is an elongated slit, with a circular through hole being provided at each end of the slit.

10. The differential-pressure sliding sleeve according to claim 1, wherein the flow guiding hole comprises two steps formed on an outer wall of the outer cylinder and opposite to each other axially, the protective element being placed on the two steps.

11. The differential-pressure sliding sleeve according to claim 1, twherein a clearance in communication with the flow guiding hole is provided between the outer cylinder and the inner cylinder, and outside of each axial end of the flow guiding hole.

12. The differential-pressure sliding sleeve according to claim 11, wherein the clearance is an enlarged hole formed on the inner wall of the outer cylinder, wherein the enlarged hole comprises a sloping surface, so that the clearance narrows in a direction away from the flow guiding hole.

13. An oil and gas well fracturing construction method using the differential pressure sliding sleeve according to claim 1, comprising:

connecting the differential-pressure sliding sleeve to a string, which is then lowered into a fracturing formation in a wellbore;

injecting working fluid into the string from a wellhead, so that the carrier ring is dissolved under the action of the working fluid;

building up pressure in the wellbore, so that the inner cylinder generates a downward pressure under the action of the working fluid, and moves downward after the pressure reaches a predetermined pressure value, thereby opening the flow guiding hole; and communicating the string with the fracturing formation to perform fracturing construction.

* * * * *